US005829624A

United States Patent [19]

Skolnik et al.

[11] Patent Number: 5,829,624

[45] Date of Patent: Nov. 3, 1998

[54] PROTECTIVE SHOE FOR OPEN TOP METAL CONTAINERS

[75] Inventors: Howard Z. Skolnik, Chicago; Ilya Solyar, Skokie, both of Ill.

[73] Assignee: Skolnik Industries, Inc., Chicago, Ill.

[21] Appl. No.: 834,844

[22] Filed: Apr. 10, 1997

[51] Int. Cl.[6] ..... B65D 45/32

[52] U.S. Cl. ..... 220/320; 292/256.6; 292/256.67

[58] Field of Search ..... 220/319, 320, 220/321, 315; 292/256.6, 256.65, 256.67, 256.69; 277/494, 495

[56] References Cited

U.S. PATENT DOCUMENTS

| | | | |
|---|---|---|---|
| 1,062,095 | 5/1913 | Hamel | 277/495 |
| 1,098,121 | 5/1914 | Magee | 277/494 X |
| 1,290,456 | 1/1919 | Wilson | 277/494 |
| 2,603,382 | 7/1952 | Kojan | 292/256.67 |
| 2,625,295 | 1/1953 | Easterday | 292/256.67 |
| 3,907,349 | 9/1975 | Kane | 292/256.67 |
| 4,358,121 | 11/1982 | Sand | 277/494 X |
| 4,651,892 | 3/1987 | Boersma | 220/320 |
| 5,697,513 | 12/1997 | Molodyi | 220/320 |

FOREIGN PATENT DOCUMENTS

| | | | |
|---|---|---|---|
| 501555 | 4/1954 | Canada | 220/320 |

*Primary Examiner*—Stephen K. Cronin
*Assistant Examiner*—Nathan Newhouse
*Attorney, Agent, or Firm*—Hill & Simpson

[57] ABSTRACT

A container securing system is provided for a round container having an upper rounded rim and an open end and a cover receivable on the open end, the cover having a rounded lip. A locking ring formed of a rounded strip is provided engaging the lip and rim around the periphery of the container when the cover is on the container, the locking ring having first and second ends with a gap therebetween. The locking ring has a securement system for pulling the first and second ends of the locking ring toward each other when the locking ring secures the cover to the container. A protective shoe formed of a curved metal strip material is positioned in the gap of the locking ring when the locking ring is securing thc cover on the container. The protective shoe has a length in a peripheral direction around the drum which is greater than a length of the gap so that end portions of the strip overlap with portions of the ends of the locking ring. The protective shoe extends at least from a region at the top of the cover lip around the cover lip and around the bottom portion of the rim to a side wall of the container directly beneath the rim.

41 Claims, 4 Drawing Sheets

PROTECTIVE SHOE FOR OPEN TOP METAL CONTAINERS

BACKGROUND OF THE INVENTION

Field of the Invention

The present invention is directed to an improvement in metal containers and more particularly to round metal containers known as drums.

As shown in FIG. 1, what are known as "open top" metal drums have the configuration as generally shown at 10. The metal drum body 11 has a side wall 11A and a rounded rim 12 at the open end thereof which receives an open top or cover 13 having a planar surface 14 surrounded by an annular upwardly slanting surface 15 which blends into a rounded lip 16 forming approximately a 180° arc segment. The lip has a sealing gasket at an inside periphery (not visible in FIG. 1), and the radius of the lip is designed to approximately match the radius of the rim so that when the cover 13 is placed on the drum body 11 the upwardly slanting surface 15 is in a press-fit relationship with an inside diameter of the drum body near the rim 12, and the lip 16 fits over the rim 12. Thereafter a locking ring 17 formed of a rounded strip 18, facing ends 18*a* and 18*b* and lugs 19 and 20 at the ends 18*a* and 18*b* can be slipped over the lip 16 and rim 12 to seat the cover 13 on the top of the drum body 11. To complete the sealing operation, a bolt 21 having threads 21*a* is aligned through the aperture 20*a* of the lug 20 and is threaded into the threads 19*a* of the lug 19 by applying a tool to the head 21*b* of the bolt. Alternatively, a nut 9 shown in dashed lines may be applied on the threads 21*a* in lieu of the threads 19*a* in the lug 19.

The lugs 19 and 20 are welded at the ends 18*a* and 18*b* of the locking ring 17 in a position such that they are angled downwardly as shown at FIG. 1.

The locking ring 17 described above provides, in conjunction with the aforementioned gasket, a tight fluid proof seal between the cover and the drum or container body 11. However, in view of the gap shown by the arrow at 22 between ends 18*a* and 18*b*, there is a portion of the periphery of the lip 16 and rim 12 which is left uncovered. This can cause potential fluid leakage at this point. Moreover, the sealing pressure around the entire periphery of the drum is disrupted at the gap 22.

It is furthermore important that drums or containers of the type shown in FIG. 1 be designed to successfully pass what are known as "drop tests" wherein the drum body is filled with fluid, and then is dropped from predetermined elevations to determine whether damage will occur to the sealing integrity of the drum. It has been known in the past that leakage can occur at the gap 22 of the locking ring 17 as a result of the drop test, and deformation of the drum can occur at this point in view of the lack of a uniform distribution of the sealing pressure about the entire periphery of the drum or container.

It is also known that a sealing gasket which is typically applied inside the lip 16 of the cover 13 can be damaged at the gap 22, since this area of the gasket is not protected when the locking ring is placed on the drum, and thus this portion of the sealing gasket can be exposed to the elements.

It was previously known in the art as shown in FIG. 2 to fill in the gap 22 at the ends 18*a* and 18*b* of the locking ring by providing an overlapping smaller curvature section 23 which overlaps inside an extension section 24 of a larger curvature as shown in FIG. 2 . Thus the gap between the ends 18*a* and 18*b* is filled in by the overlapping sections.

With this system, however, there is the significant disadvantage that existing rings already on the market and in the field must be thrown away and replaced with the overlapping locking ring-type as described above. This is not a practical approach in view of the many millions of locking rings currently existing in the field which are in continual re-use. Moreover, the manufacturing expense for the overlapping locking ring described above is significant, which is an important consideration for a commodity item such as locking rings where profit margins are low.

SUMMARY OF THE INVENTION

It is an object of the invention to solve the sealing problems described above with a low cost solution which also is compatible with existing locking rings in the field.

According to the present invention, a container securing system and method is provided wherein a round container having an upper rounded rim at an open end thereof receives a cover at the open end, the cover having a rounded lip for substantially mating with and partially covering an upper portion of the rim when the cover is applied on the container. A locking ring formed of a rounded strip engaging the lip and rim around the periphery of the container is provided for sealing the cover on the container. The locking ring has first and second ends with a gap therebetween. The locking ring has a securement system for pulling the first and second ends of the locking ring towards each other when the locking ring secures the cover to the container. A protective shoe formed of a curved strip of material is positioned in the gap of the locking ring when the locking ring is securing the cover on the container. The protective shoe has a length in a peripheral direction around the drum which is greater than a length of the gap so that end portions of the strip overlap with portions of the ends of the locking ring. The protective shoe extends at least from a region at the top of the cover lip around the cover lip and around the bottom portion of the rim to a side wall of the container directly beneath the rim.

Other objects and advantages of the present invention will be apparent upon reference to the accompanying description when taken in conjunction with the following drawings.

DETAILED DESCRIPTION OF THE PREFERRED EMBODIMENTS

Figure 1:
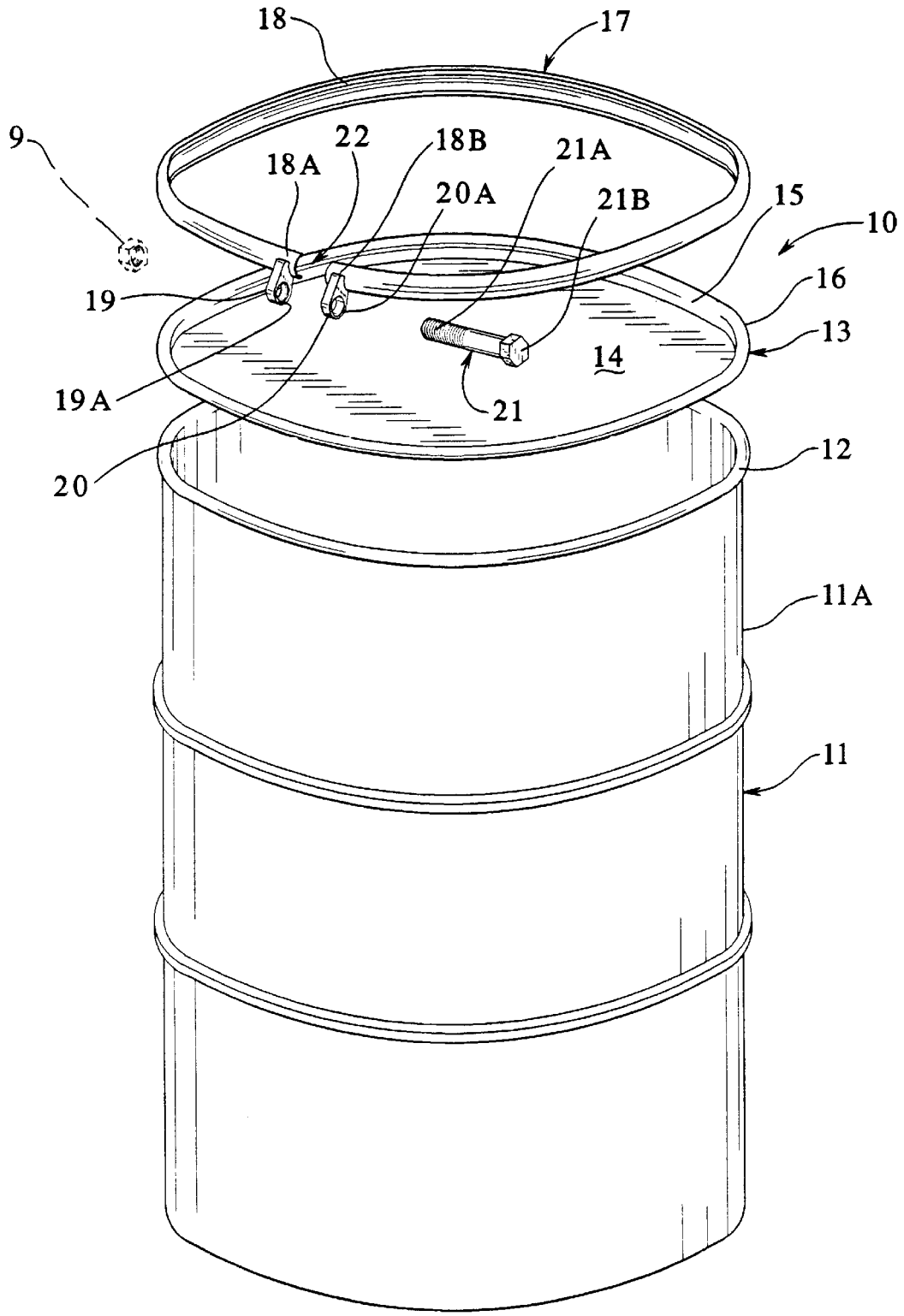
FIG. 1 (PRIOR ART)
FIG. 1 is a perspective view of a prior art drum or container system having an open top cover retained by a prior art locking ring.
Figure 2:
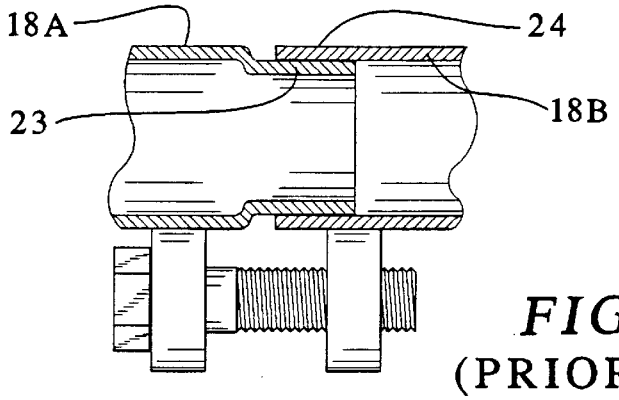
FIG. 2 (PRIOR ART)
FIG. 2 shows a fragmentary rear view of a prior art locking ring attempting to solve fluid sealing problems existing in the prior art locking ring system of FIG. 1.
Figure 3:
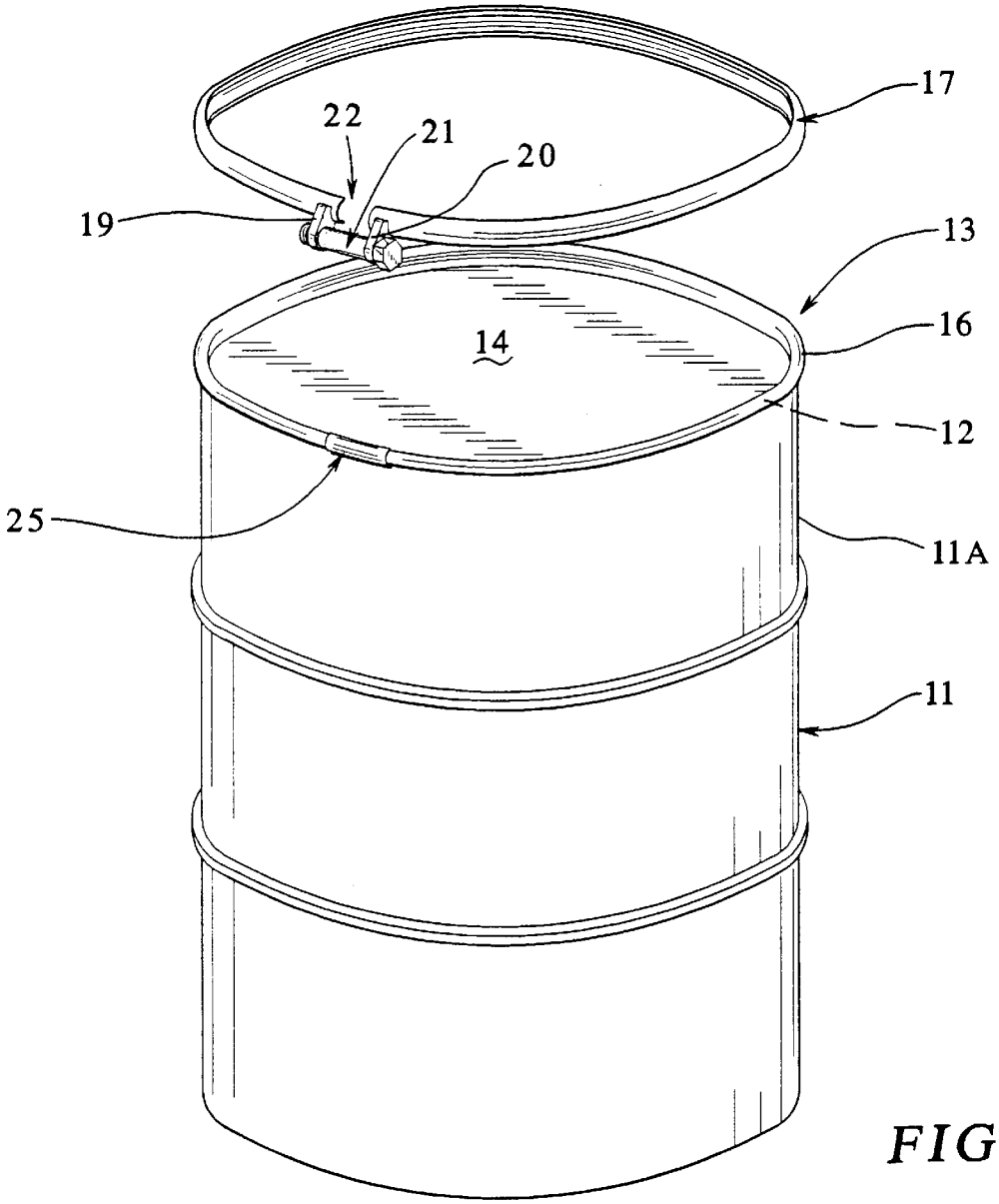
FIG. 3 is a perspective view showing a first embodiment of the invention employing a protective shoe which is compatible with existing locking rings to improve sealing for open top metal containers.

The first embodiment of the present invention is shown in FIG. 3. There, the same drum or container body 11 as FIG. 1 is provided having the same style of the rim 12 covered by an open top or cover 13 having the same type of lip 16 as in the prior art cover shown in FIG. 1. Such a drum can be, for example, a 30 gallon, 55 gallon, or 85 gallon drum, including what are known as "salvage" drums. Furthermore, the locking ring 17 is the same as in the prior art design shown in FIG. 1. However, according to the invention a protective shoe 25 is arranged as shown more clearly in FIGS. 4 and 5 over the lip 16 and rim 12 of the cover 13 and drum body 11, respectively. The protective shoe 25 is retained in this position by a spring force to be described hereafter. After application of the protective shoe 25, the locking ring 17 is then applied such that the gap 22 overlies and is centered over the protective shoe 25. Since the protective shoe 25 is longer than the gap 22, it covers the gap when the locking ring 17 is applied. Thereafter, the bolt 21 is threaded into the lug 19 and the locking ring is secured on the drum.

Figure 4:
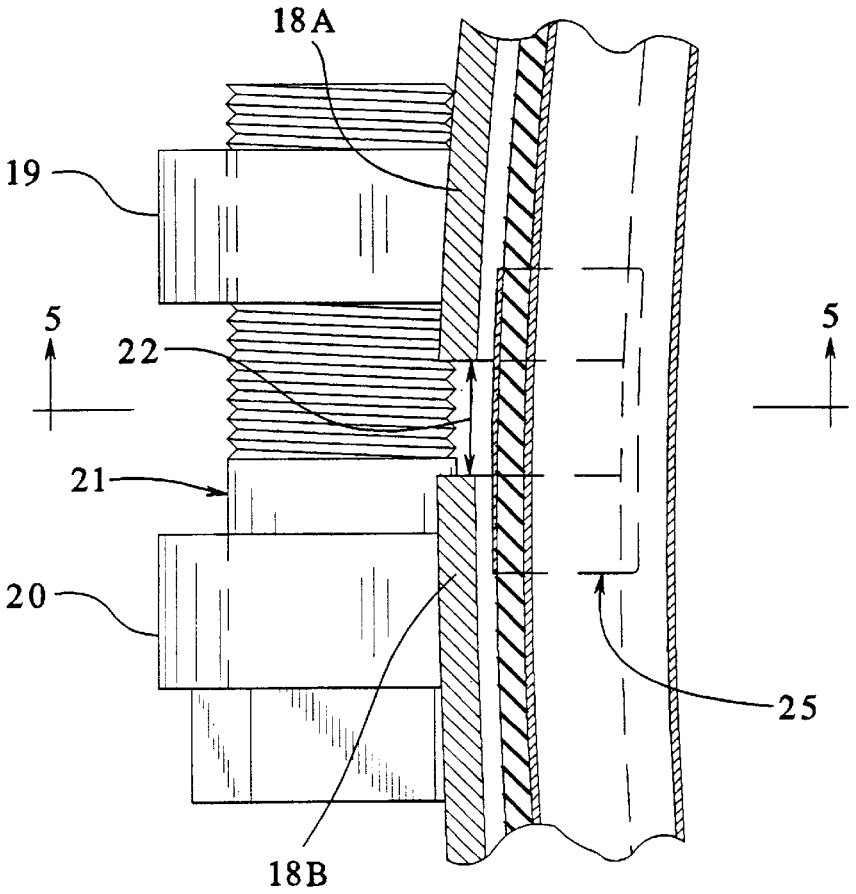
FIG. 4 is a fragmentary cross-sectional view taken along Section line 4—4 in FIG. 5 showing the invention of FIG. 3.
Figure 5:
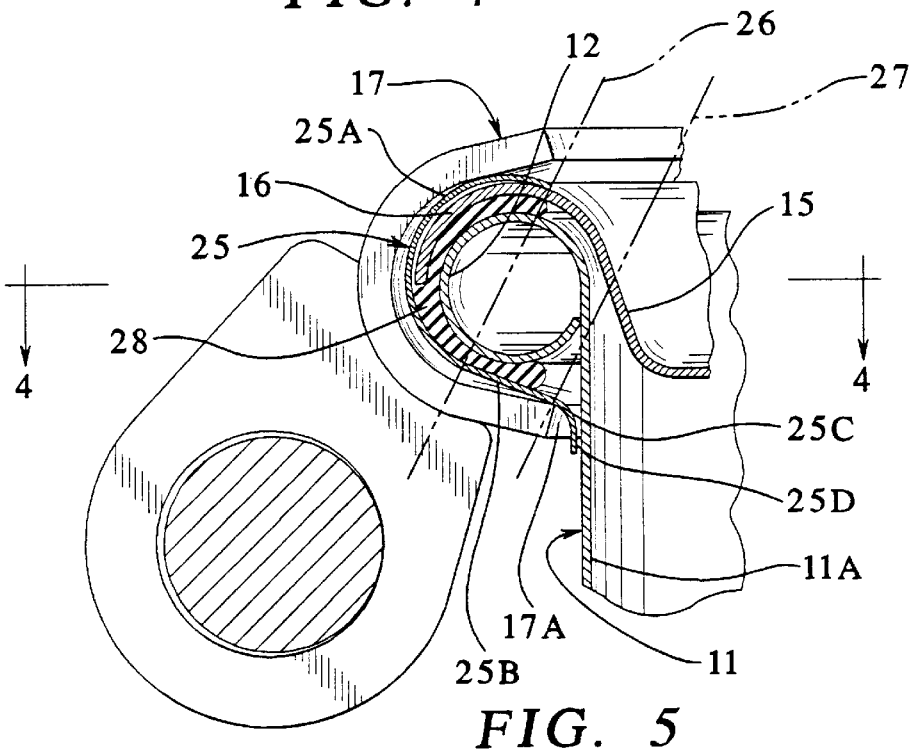
FIG. 5 is a sectional view taken along section line 5—5 of the first embodiment of the invention of FIG. 3.

More particularly as shown in FIGS. 4 and 5, the protective shoe 25 has an optimum extension length in the peripheral direction of three to four inches with the preferred length being approximately 3½ inches. As shown in the cross-sectional view of FIG. 5, the shoe has a substantially circular arc segment 25A lying to the upper left of the dashed line 26 of approximately a 180° arc. Thereafter, there is a straight section 25B indicated between the dashed lines 26 and 27. Thereafter there is a rounded section 25C followed by a short straight vertical section 25D.

As can be seen in FIG. 5, the protective shoe 25 covers over the exposed portion of the gasket 28 at the gap 22 extending below the lip 16.

Preferably the entire meandering length of the protective shoe from a top edge to a bottom edge is 1.75 to 2.5 inches with a preferred length of approximately 2 inches.

Preferably the protective shoe is constructed of 22 gauge steel such as cold roll carbon steel, although stainless steel can also be employed. The protective shoe should be no thicker than 20 gauge.

The radius of the 180° segment 25A is slightly smaller than the radius of the lip 16, so that a springy press-fit relationship can be obtained when the protective shoe is applied to the lip 16 and rim 12 with the cover on the drum prior to the application of the locking ring. Thus, the locking ring gap 22 can be centered over the protective shoe without the shoe moving around the periphery of the drum during the installation of the locking ring.

With the embodiment of FIGS. 3, 4 and 5, the prior art locking ring can be employed and the protective shoe can be retrofitted for use with existing locking rings, covers and drums in the field without modifications thereto. Furthermore, the fluid sealing capability and the ability to withstand drop testing is significantly increased by use of the protective shoe, since it fills in the gap and, the locking ring interacting and together with the protective shoe can then provide a continuous sealing pressure around the entire 360° periphery of the drum. The overall strength of the drum is significantly increased and the chance of leakage at the gap is significantly reduced. Furthermore, damage to the gasket 28 at the gap of the locking ring is eliminated.

Moreover, by providing the short straight section 25D, it can be seen that the locking ring will pull the protective shoe even tighter at the gap, since the edge 17A of the locking ring presses against the rounded portion 25C and clamps the short straight section 25D against the body side wall 11A of the drum 11. The protective shoe is thus securely held in position.

Figure 6A:
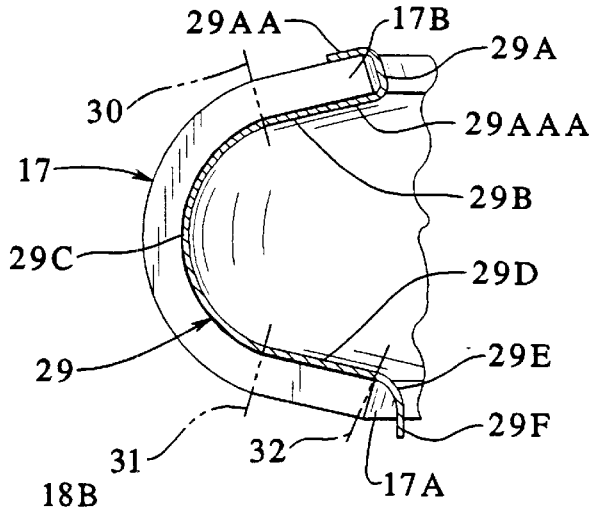
FIG. 6A is a fragmentary cross-sectional view of a second embodiment of the invention.
Figure 6B:
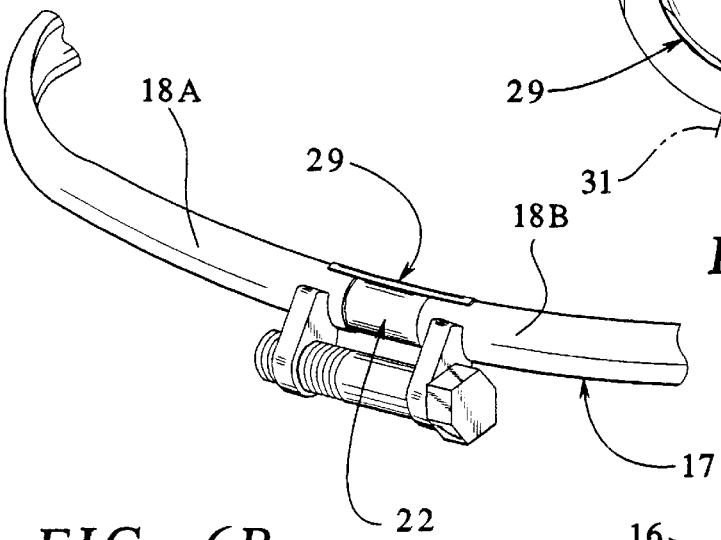
FIG. 6B is a perspective fragmentary view of the second embodiment of FIG. 6A.

A second embodiment of the invention is shown in FIGS. 6A and 6B. Here, the protective shoe 29 of the invention is first fitted to the prior art locking ring 17 before the locking ring is applied to the drum body for securing the cover 13. As shown in FIG. 6B, the protective shoe 29 is positioned at the gap 22 between the ends 18A and 18B and is held there by a springy clamping force provided by the U-shaped lip 29A which clamps onto the upper edge 17B. Thus when the protective shoe 29 has not yet been applied, then the upper portion 29AA is bent inwardly slightly such that the leading edge of the upper portion 29AA is spaced from the lower portion 29AAA of the U-shaped lip by a distance which is slightly less distance than the thickness of the edge 1 7B at the top of the locking ring. Thus, when the protective shoe 29 is slipped onto the locking ring at the gap 22, it is retained at the gap.

As shown in FIG. 6A, between the U-shaped lip 29A and dashed line 30 is a substantially straight section 29B. Thereafter, between the dashed lines 30 and 31 an arc segment 29C is provided where the arc is approximately 150°. The radius of this arc segment is substantially the same as the radius of the drum ring 17 at this region. Thereafter, a second straight section 29D is provided between the dashed lines 31 and 32. Thereafter, a rounded section 29E is provided which then merges into a short vertical section 29F. The longitudinal extent in the horizontal direction of the protective shoe 29 is the same as that specified for the first embodiment. The preferred overall meandering length of the protective shoe from a top edge to a bottom edge, is approximately 2¼ inches within a range of 2 to 2¾ inches. The gauge is the same as the first embodiment. Sealing capabilities for this embodiment are similar to the first embodiment.

Figure 7A:
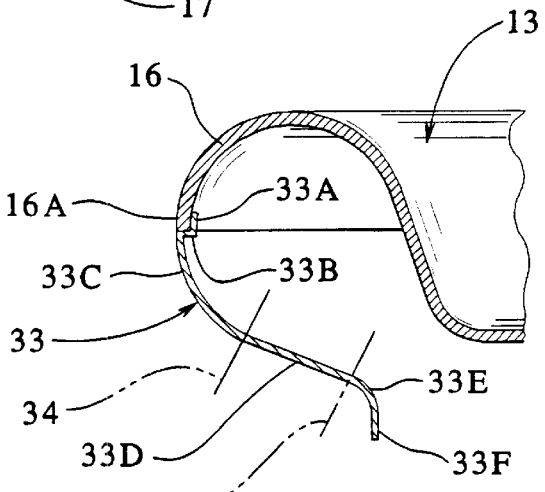
FIG. 7A is a cross-sectional fragmentary view of a third embodiment of the invention.
Figure 7B:
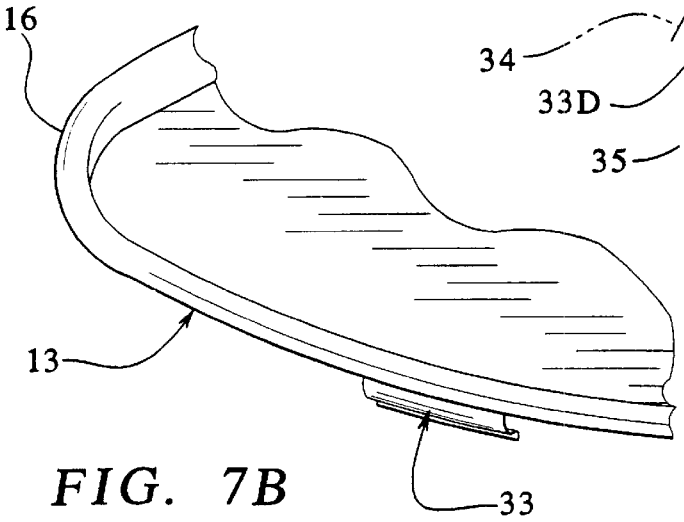
FIG. 7B is a fragmentary perspective view of the third embodiment of FIG. 7A.

In a third embodiment of the invention as shown in FIGS. 7A and 7B, the protective shoe 33 is spot welded at the inside surface of the edge 16A of the lip 16 of the cover 13 prior to application of the cover on the drum body. A short vertical mounting section 33A is provided for this spot welding attachment. A horizontal transition section 33B is provided so that the curved arc segment portion 33C matches the exterior radius of the cover lip 16 so that a smooth transition without a gap or step occurs from the edge 16A to the protective shoe 33. The arc segment 33C extends from the horizontal portion 33B down to the dashed line 34 and represents an arc segment of approximately 60°. Thereafter, a straight section 33D is provided followed by a rounded section 33E and thereafter a short vertical section 33F.

The overall meandering length of the protective shoe from a top edge to a bottom edge is approximately 1⅝ inch optimum and within a range from 1½ inches to 1¾ inches. The vertical mounting section 33A is approximately ¼ inch long and within a range of ⅛ inch to ⅜ inch. The length in a lateral direction around the periphery of the drum is the same as the first and second embodiments, as is the steel type.

With the third embodiment, since the protective shoe is made of a sufficiently thin material so as to be springy, when the drum cover 13 is applied onto the drum body 11, the protective shoe is bent slightly downwardly to allow the drum rim 12 to pass into the interior region defined by the lip 16 and the protective shoe 33. The protective shoe 33 to some extent springs back into place. In any event, the locking ring 17 which is then applied takes care of any temporary deformation which may have occurred in the protective shoe since the locking ring lower edge 17A pushes the short straight section 33F against the side wall 11A drum body 11 similar to the first and second embodiments. Of course when the locking ring is applied, it is positioned so that the gap 22 overlies and is centered with respect to the protective shoe 33.

Although various minor changes and modifications might be proposed by those skilled in the art, it will be understood that our wish is to include within the claims of the patent warranted hereon all such changes and modifications as reasonably come within our contribution to the art.

We claim as our invention:

1. A container securing system, comprising:

a round container having an upper rounded rim at an open end thereof;

a cover receivable on said open end of said container and having a rounded lip for substantially mating with and partially covering an upper portion of said rim when said cover is placed on said container;

a locking ring formed of a rounded strip engaging the lip and rim around a periphery of the container when the cover is on the container, said locking ring having first and second ends with a gap therebetween and without any overlapping of the first and second ends after securement of the locking ring to the container has been completed;

said locking ring having a securement system for pulling the first and second ends of the locking ring towards each other when the locking ring secures the cover to the container; and a separate protective shoe formed of a curved strip of material which is positioned in the gap of the locking ring when the locking ring is on the container securing the cover but without being directly fastened to the locking ring or the cover, said protective shoe having a length in a peripheral direction around the drum which is greater than a length of the gap so that end portions of the strip overlap with portions of the ends of the locking ring, and the protective shoe extending at least from a region at the top of the cover lip around the cover lip and around a bottom portion of the rim.

2. The system according to claim 1 wherein the protective shoe has a short vertical section at a bottom end of the protective shoe which is pressed against a side wall of the container by a lower edge of the locking ring pressing against a lower portion of the protective shoe.

3. The system according to claim 1 wherein the protective shoe has an arc segment section which transitions into a straight section, followed by a rounded section which is then followed by a short vertical section.

4. The system according to claim 3 wherein the arc segment section is approximately 180°.

5. The system according to claim 3 wherein an entire meandering length of the protective shoe from a top edge to a bottom edge in a range of 1.75 to 2.5 inches.

6. The system according to claim 5 wherein the length is approximately 2 inches.

7. The system according to claim 1 wherein in the peripheral direction the protective shoe has a length in a range from 3 to 4 inches.

8. The system according to claim 7 wherein the peripheral direction length is approximately 3.5 inches.

9. The system according to claim 1 wherein the protective shoe comprises a steel strip of 20 gauge or thinner.

10. The system according to claim 9 wherein the steel strip gauge is approximately 22 gauge.

11. The system according to claim 1 wherein the securement system comprises first and second lugs at the first and second ends of the locking ring and wherein a bolt with a thread pulls the lugs towards one another.

12. The system according to claim 11 wherein one of the lugs has a threaded aperture for receiving the thread on the bolt.

13. The system according to claim 11 wherein the bolt passes through an aperture in the first lug, passes through an aperture in the second lug, and engages with a nut.

14. The system according to claim 1 wherein the protective shoe at an upper end has a U-shaped lip for surrounding engagement with an upper leading edge of the locking ring.

15. The system according to claim 14 wherein the protective shoe has after the U-shaped lip a straight section followed by an arc segment section, another straight section, a rounded sections and then a short straight vertical section.

16. The system according to claim 15 wherein an entire meandering length of the shoe from a top edge to a bottom edge lying in a range of 2 to 2¾ inches.

17. The system of claim 16 wherein the vertical length is approximately 2¼ inches.

18. The system according to claim 15 wherein the arc segment section is an arc segment of approximately 150°.

19. The system according to claim 15 wherein the arc segment section has a radius substantially the same as an interior radius of the locking ring where the arc segment section of the protective shoe presses against it.

20. The system according to claim 14 wherein the U-shaped lip comprises an upper portion spaced from a lower portion with the upper portion being angled down toward the lower portion when the shoe is not fitted on the locking ring so that a press fit occurs in springy fashion when the protective shoe is placed on the locking ring at the gap with the U-shaped lip engaging the upper locking edge of the locking ring.

21. The system according to claim 1 wherein the round container comprises one of the drums selected from the group consisting of a 30 gallon drum, a 55 gallon drum, and an 85 gallon drum.

22. A container securing system, comprising:

a round container having an upper rounded rim at an open end thereof;

a cover receivable on said open end of said container and having a rounded lip for substantially mating with and partially covering an upper portion of said rim when said cover is placed on said container;

a locking ring formed of a rounded strip engaging the lip and rim around a periphery of the container when the cover is on the container, said locking ring having first and second ends with a gap therebetween and without any overlapping of the first and second ends after securement of the locking ring to the container has been completed;

said locking ring having a securement system for pulling the first and second ends of the locking ring towards each other when the locking ring secures the cover to the container;

a separate protective shoe formed of a curved strip of material which is positioned in the gap of the locking ring when the locking ring is on the container securing the cover but without being directly fastened to the locking ring or the cover, said protective shoe having a length in a peripheral direction around the drum which is greater than a length of the gap so that end portions of the strip overlap with portions of the ends of the locking ring, and the protective shoe extending at least from a region at the top of the cover lip around the cover lip and around a bottom portion of the rim; and the protective shoe having an upper portion which is attached to a lower edge of the lip of the cover.

23. The system according to claim 22 wherein the protective shoe has a short vertical mounting section welded at an inside of the lower edge of the lip, followed by a short horizontal section, an arc segment section, a straight inclined section, a rounded section, and then a short vertical section.

24. The system according to claim 23 wherein the short horizontal section has a length chosen such that a transition from an outer surface of the lip to an outer surface of the protective shoe is smooth without a step.

25. The system according to claim 22 wherein an entire meandering length of the protective shoe from a top edge to a bottom edge is in a range from 1½ to 1¼ inch.

26. The system according to claim 25 wherein the vertical length is approximately 1⅝ inches.

27. A container securing system, comprising:

a round container having an upper rounded rim at an open end thereof;

a cover receivable on said open end of said container and having a rounded lip for substantially mating with and partially covering an upper portion of said rim when said cover is placed on said container;

a locking ring formed of a rounded strip engaging the lip and rim around a periphery of the container when the cover is on the container, said locking ring having first and second ends with a gap therebetween and without any overlapping of the first and second ends after securement of the locking ring to the container has been completed;

said locking ring having a securement system for pulling the first and second ends of the locking ring towards each other when the locking ring secures the cover to the container;

a separate protective shoe formed of a curved strip of material which is positioned in the gap of the locking ring when the locking ring is on the container securing the cover but without being directly fastened to the locking ring or the cover, said protective shoe having a length in a peripheral direction around the drum which is greater than a length of the gap so that end portions of the strip overlap with portions of the ends of the locking ring, and the protective shoe extending at least from a region at the top of the cover lip around the cover lip and around a bottom portion of the rim;

the protective shoe having an arc segment section which transitions into a straight section, followed by a rounded section which is then followed by a short vertical section; and the arc segment section having a radius slightly less than a radius of the lip.

28. A container locking ring system for a round container having an upper rounded rim at an open end thereof, and a cover receivable on said open end of said container and having a rounded lip for substantially mating with and partially covering an upper portion of said rim when said cover is placed on said container; comprising:

a locking ring formed of a rounded strip engaging the lip and rim around a periphery of the container when the cover is on the container, said locking ring having first and second ends with a gap therebetween and without any overlap of the first and second ends when the locking ring is fully secured on the container;

said locking ring having a securement system for pulling the first and second ends of the locking ring towards each other when the locking ring is on the cover and container;

a separate protective shoe formed of a strip which is not integral with the locking ring nor with the lip of the cover which is positioned in the gap of the locking ring when the locking ring is on the container and wherein said protective shoe has a length in a peripheral direction around the container which is greater than the gap and which extends at least from a region at a top of the cover lip around the cover lip and around a bottom portion of the rim to a region adjacent a side wall of the container beneath the rim and the protective shoe having a short vertical section at a bottom end of the protective shoe which is pressed against a side wall of the container by a lower edge of the locking ring pressing against a lower portion of the protective shoe.

29. A method for securely attaching a container cover to an open end of a container where the container has a rounded rim at the open end thereof and the cover has a rounded lip partially covering a top portion of the rim when the cover is placed on the container, comprising the steps of:

providing a locking ring having a rounded strip section and ends with a gap therebetween, and providing a securement system for pulling the ends of the locking ring towards each other after the locking ring is applied onto the cover lip and the rim of the container;

providing a curved protective shoe formed of a strip of material having a length in a peripheral direction of the container which is longer than said gap of the locking ring;

placing the cover on the open end of the container;

placing the protective shoe on a short peripheral portion of the lip and rim and retaining it there by a springy press fit;

applying the locking ring onto the cover and container such that the gap of the locking ring overlies the protective shoe and is substantially centered thereat; and pulling the ends of the locking ring toward each other with the securement system.

30. The method according to claim 29 wherein the protective shoe runs at least from a top portion of the rim downwardly around the rim in an arc-like section to a straight section, thereafter to a rounded section, and thereafter to a short vertical section, and wherein a lower edge of the locking ring pushes the short vertical section against a vertical side-wall of the container beneath the rim.

31. The method according to claim 30 wherein the arc-like section has a radius slightly less than a radius of the lip and wherein a material of the protective shoe is formed of steel so that it is springy, and will provide said press fit.

32. A method for securely attaching a container cover to an open end of a container where the container has a rounded rim at the open end thereof and the cover has a rounded lip partially covering the top portion of the rim when the cover is placed on the container, comprising the steps of:

providing a locking ring having a rounded strip section and ends with a gap therebetween, and providing a securement system for pulling the ends of the locking ring toward each other after the locking ring is applied onto the cover lip and the rim of the container;

providing a curved protective shoe formed of a strip of material having a length in a peripheral direction of the container which is longer than said gap of the locking ring;

welding the protective shoe at a lower edge of the lip of the cover;

placing the cover with the welded protective shoe attached thereto on the open end of the container;

applying the locking ring onto the cover and container such that the gap of the locking ring overlies the protective shoe and is substantially centered thereat; and pulling the ends of the locking ring toward each other with the securement system.

33. The method according to claim 32 including the step of providing the protective shoe with a short verticle section for mounting by said welding, and a short horizontal section having a length chosen such that an outer surface of a following arc segment section of the protective shoe has a smooth transition from an outer surface of the lip of the cover.

34. A method for securely attaching a container cover to an open end of a container where the container has a rounded rim at the open end thereof and the cover has a rounded lip partially covering a top portion of the rim when the cover is placed on the container, comprising the steps of:

providing a locking ring having a rounded strip section and ends with a gap therebetween, and providing a securement system for pulling the ends of the locking ring toward each other after the locking ring is applied onto the cover lip and the rim of the container;

providing a curved protective shoe formed of a strip of material having a length in a peripheral direction of the container which is longer than said gap of the locking ring, and providing an upper end of the protective shoe with a U-shape section which fits over an upper edge of the locking ring to keep the protective shoe positioned on the locking ring at the gap and substantially centered at the gap prior to application of the locking ring onto the container;

placing the cover on the open end of the container;

placing the protective shoe on the locking ring at the gap by use of said U-shape section;

applying the locking ring onto the drum with the protective shoe in position; and pulling the ends of the locking ring towards each other with the securement system, but with a gap remaining between the ends and the ends not overlapping after securement is completed.

35. A method for securely attaching a container cover to an open end of the container where the container has a rounded rim at the open end thereof and the cover has a rounded lip partially covering a top portion of the rim when the cover is placed on the container comprising the steps of:

providing a locking ring having a rounded strip section and ends with a gap therebetween, and providing a securement system for pulling the ends of the locking ring towards each other after the locking ring is applied onto the cover lip and the rim of the container;

providing a curved protective shoe formed of a strip of material having a length in a peripheral direction of the container which is longer than said gap of the locking ring;

attaching the protective shoe at a lower edge of the lip of the cover;

applying the cover to the container at the open end thereof; and placing the locking ring into position so that the gap is centered at the protective shoe for securing the cover to the container, and then pulling the ends of the locking ring towards each other by use of said securement system.

36. The method according to claim 35 including the step of welding the protective shoe at an inside surface at the lower edge of the lip and providing the protective shoe with a short vertical section for mounting, said short horizontal section having a length chosen such that an outside surface of a following arc-segment section of the protective shoe has a smooth transition from an outer surface of the lip.

37. The method according to claim 36 wherein the protective shoe after the arc segment section has a substantially straight section followed by a rounded section followed by a substantially vertical short section.

38. The method according to claim 37 wherein a lower edge of the locking ring pushes the vertical short section against a side wall of the drum when the locking ring is applied.

39. A protective shoe for use with a round container having an upper rounded rim at an open end thereof wherein the round container has a cover receivable on said open end of said container and having a rounded lip for substantially mating with and partially covering an upper portion of said rim when said cover is placed on said container, wherein a locking rim is provided formed of a rounded strip engaging the lip and rim around the periphery of the container when the cover is on the container, said locking ring having first and second ends with a gap therebetween and without any overlapping of the first and second ends after securement of the locking ring to the container has been completed, and wherein the locking ring has a securement system for pulling the first and second ends of the locking ring towards each other when the locking ring secures the cover to the container, said protective shoe comprising:

the protective shoe being separated and formed of a curve strip of material which is positioned in the gap of the locking ring when the locking ring is on the container securing the cover but without being directly fastened to the locking ring or the cover, said protective shoe having a length in a peripheral direction around the drum which is greater than a length of the gap so that end portions of the strip overlap with portions of the ends of the locking ring, and the protective shoe extending at least from a region at the top of the cover lip around the cover lip and around the bottom portion of the rim.

40. The shoe according to claim 39 wherein the protective shoe has a short vertical section at a bottom end of the protective shoe which is positioned to be pressed against a side wall of the container by a lower edge of the locking ring pressing against the lower portion of the protective shoe.

41. A method for securely attaching a container cover to an open end of a container where the container has a rounded rim at the open end thereof and the cover has a rounded lip partially covering a top portion of the rim when the cover is placed on the container, comprising the steps of:

providing a locking ring having a rounded strip section and ends with a gap therebetween, and providing a securement system for pulling the ends of the locking ring toward each other after the locking ring is applied onto the cover lip and the rim of the container;

providing a curved protective shoe formed of a strip of material having a length in a peripheral direction of the container which is longer than said gap of the locking ring, and providing an upper end of the protective shoe with a U-shape section which fits over an upper edge of the locking ring to keep the protective shoe positioned on the locking ring at the gap and substantially centered at the gap prior to application of the locking ring onto the container;

placing the cover on the open end of the container;

applying the locking ring onto the drum;

placing the protective shoe on the locking ring at the gap by use of said U-shape section; and pulling the ends of the locking ring towards each other with the securement system, a gap remaining between the locking ring ends and the locking ring ends not overlapping.

* * * * *